US007134989B2

(12) United States Patent
Liao

(10) Patent No.: US 7,134,989 B2
(45) Date of Patent: Nov. 14, 2006

(54) MULTIFUNCTION EXERCISE MACHINE

(75) Inventor: Hsueh-Hu Liao, Shenzhen (CN)

(73) Assignee: HL Corporation, Baoan District (CN)

( * ) Notice: Subject to any disclaimer, the term of this patent is extended or adjusted under 35 U.S.C. 154(b) by 0 days.

(21) Appl. No.: 10/894,551

(22) Filed: Jul. 20, 2004

(65) Prior Publication Data

US 2005/0101443 A1 May 12, 2005

Related U.S. Application Data

(60) Provisional application No. 60/536,067, filed on Jan. 13, 2004.

(30) Foreign Application Priority Data

Nov. 8, 2003 (CN) ..... 2003 2 0117932

(51) Int. Cl.
*A63B 26/00* (2006.01)

(52) U.S. Cl. ..... 482/142; 482/148

(58) Field of Classification Search ..... 482/142; D21/676, 686, 690, 688, 622, 695
See application file for complete search history.

(56) References Cited

U.S. PATENT DOCUMENTS

| | | | | |
|---|---|---|---|---|
| 3,421,760 | A * | 1/1969 | Freeman, Jr. | 482/80 |
| 4,068,895 | A * | 1/1978 | Reese et al. | 299/70 |
| 4,538,807 | A * | 9/1985 | Rice | 482/147 |
| 5,695,438 | A * | 12/1997 | Bjørnsti | 482/144 |
| 5,722,917 | A * | 3/1998 | Olschansky et al. | 482/72 |
| 6,398,699 | B1 * | 6/2002 | Yang | 482/142 |
| 6,752,745 | B1 * | 6/2004 | Davis | 482/72 |
| 6,918,861 | B1 * | 7/2005 | Liao et al. | 482/57 |
| 2003/0162639 | A1 * | 8/2003 | Hsien | 482/144 |
| 2005/0272576 | A1 * | 12/2005 | Simmons | 482/123 |

* cited by examiner

*Primary Examiner*—Lori Amerson
(74) *Attorney, Agent, or Firm*—Eric Karich

(57) ABSTRACT

An exercise machine has a swing structure mounted on a frame for both swinging and lateral movement. The frame has a top portion. A ring is pivotally connected to the top portion of the frame. The swing structure is rotatably coupled to the ring and adapted for engaging the feet of a user. A seat is attached to an upper surface of the swing structure.

1 Claim, 4 Drawing Sheets

MULTIFUNCTION EXERCISE MACHINE

CROSS-REFERENCE TO RELATED APPLICATIONS

This application for a utility patent claims the benefit of U.S. Provisional Application No. 60/536,067, filed Jan. 13, 2004.

The previous application is hereby incorporated by reference in its entirety.

BACKGROUND OF THE INVENTION

1. Field of the Invention

This invention relates generally to exercise machines, and more particularly to a multi-functional swing exercise machine.

2. Description of Related Art

It is well known that physical activity is required to develop and maintain physical fitness. Many different types of exercise machines are available that are designed to force one or more muscles to push or pull against a mechanical resistance. However, most exercise machines are large, heavy and structurally complex. It would be beneficial to have an exercise machine that is relatively small and simple, and light enough in weight to be highly portable.

Besides exercising to stay in shape and lose weight, people exercise to build muscles and relieve stress. Unfortunately, it is difficult to tone muscles without the use of weights or a means of resistance. Accordingly, people are limited as to where they can exercise to effectively tone their body areas and parts.

For example, Davis, U.S. Pat. No. 6,752,745, teaches an exercise apparatus utilized for toning and building muscles in different areas of the body, including the arms, chest, shoulders, abdominal muscles, thighs, calves, and hips. The exercise apparatus has a support assembly, having a horizontal bottom support bar, and various components positioned along the support bar. The components include a seat assembly located at the rear end, a pair of thigh press bars located at the middle portion, a foot support assembly located at the front end, and elastic bands. The elastic bands are attached between different movable parts of the apparatus in order to provide resistance to the user when attempting to move such movable parts with respect to each other while exercising. The above-described reference is hereby incorporated by reference in full.

The prior art teaches exercise machines for toning the abdominal portion of a user's body. However, the prior art does not teach a swinging type exercise device that includes the structures and benefits of the exercise machine described below. The present invention fulfills these needs and provides further related advantages as described in the following summary.

SUMMARY OF THE INVENTION

The present invention teaches certain benefits in construction and use which give rise to the objectives described below.

The present invention provides an exercise machine that includes a swing structure mounted on a frame for both swinging and lateral movement. The frame has a top portion. A ring is pivotally connected to the top portion of the frame. The swing structure is rotatably coupled to the ring and adapted for engaging the feet of a user. A seat is attached to an upper surface of the swing structure.

A primary objective of the present invention is to provide an exercise machine having advantages not taught by the prior art.

Another objective is to provide an exercise machine that provides a strong abdominal workout without requiring a weight stack.

A further objective is to provide an exercise machine that enables a user to exercise his or her abdominal muscles using both a swinging action, and a lateral action.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
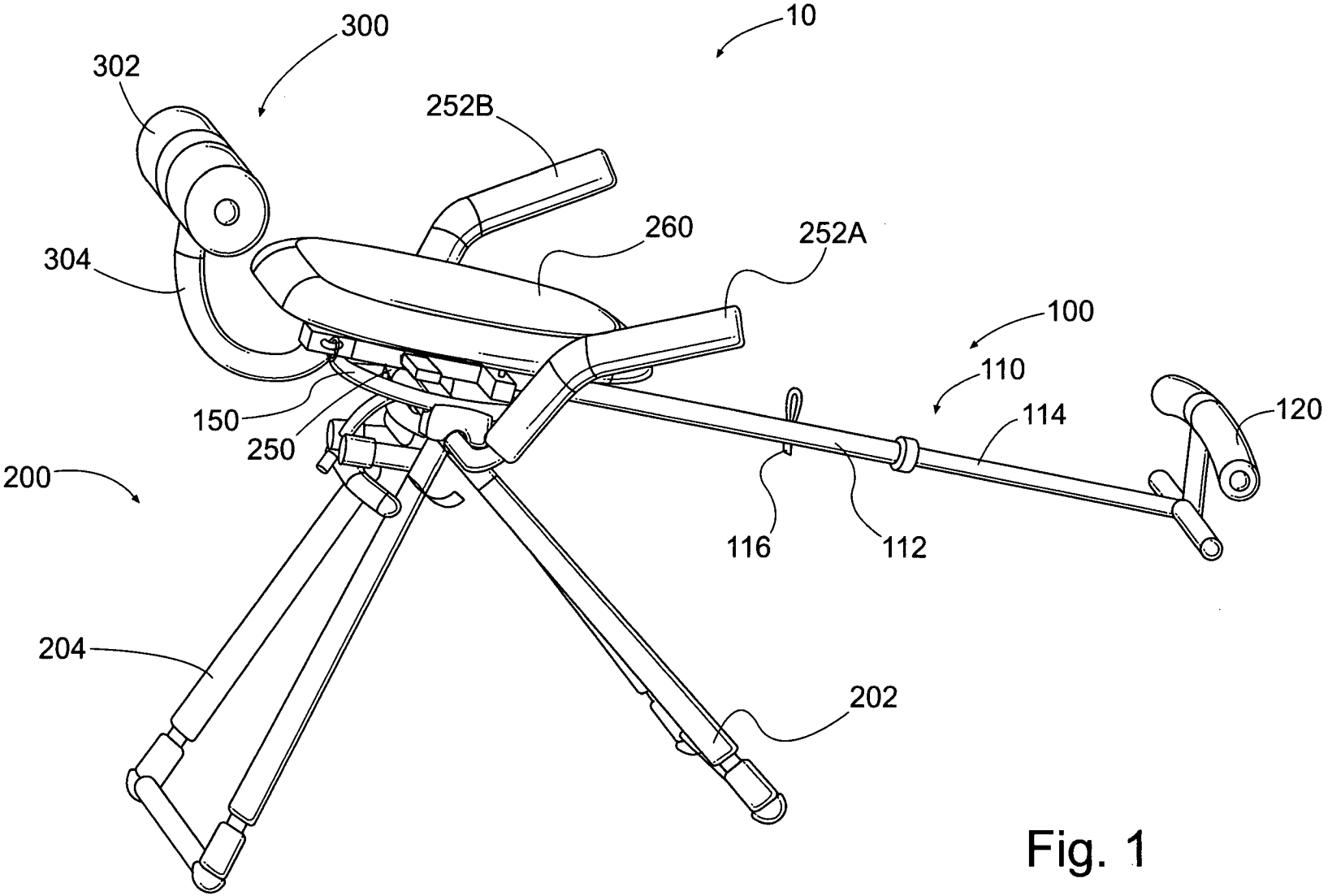
FIG. 1 is a perspective view of one embodiment of a multifunction exercise machine for exercising muscles of a human user.

FIG. 1 is a perspective view of one embodiment of a multifunction exercise machine 10 for exercising muscles of a human user, specifically the muscles of the abdomen and/or the lower back and the legs. In the embodiment of FIG. 1, the exercise machine 10 includes a swing structure 100 rotatably coupled to a ring 150, and the ring 150 is pivotally connected to an underlying frame 200. The frame 200 includes a front frame member 202 and a back frame member 204 having upper portions connected together to form a top portion of the frame 200. A horizontal bar 250 is adjustably clamped to the top portion of the frame 200. A pair of handle bars 252A and 252B, which are preferably curved and padded, extend upward from opposite ends of the horizontal bar 250.

Figure 3:
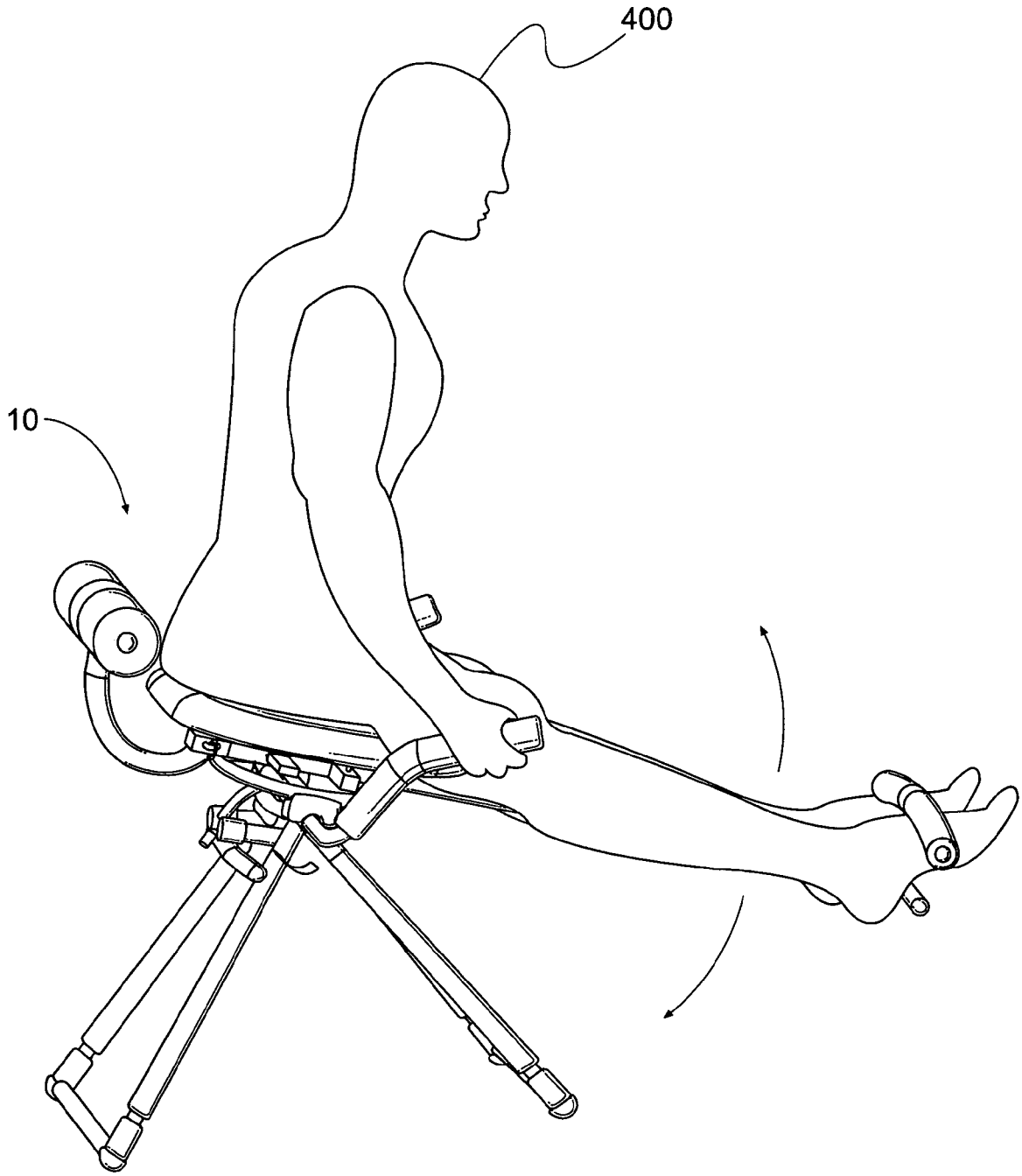
FIG. 3 is a perspective view of a user positioned on the exercise machine of FIGS. 1 and 2, wherein the user is alternately raising and lowering his or her legs in unison.
Figure 4:
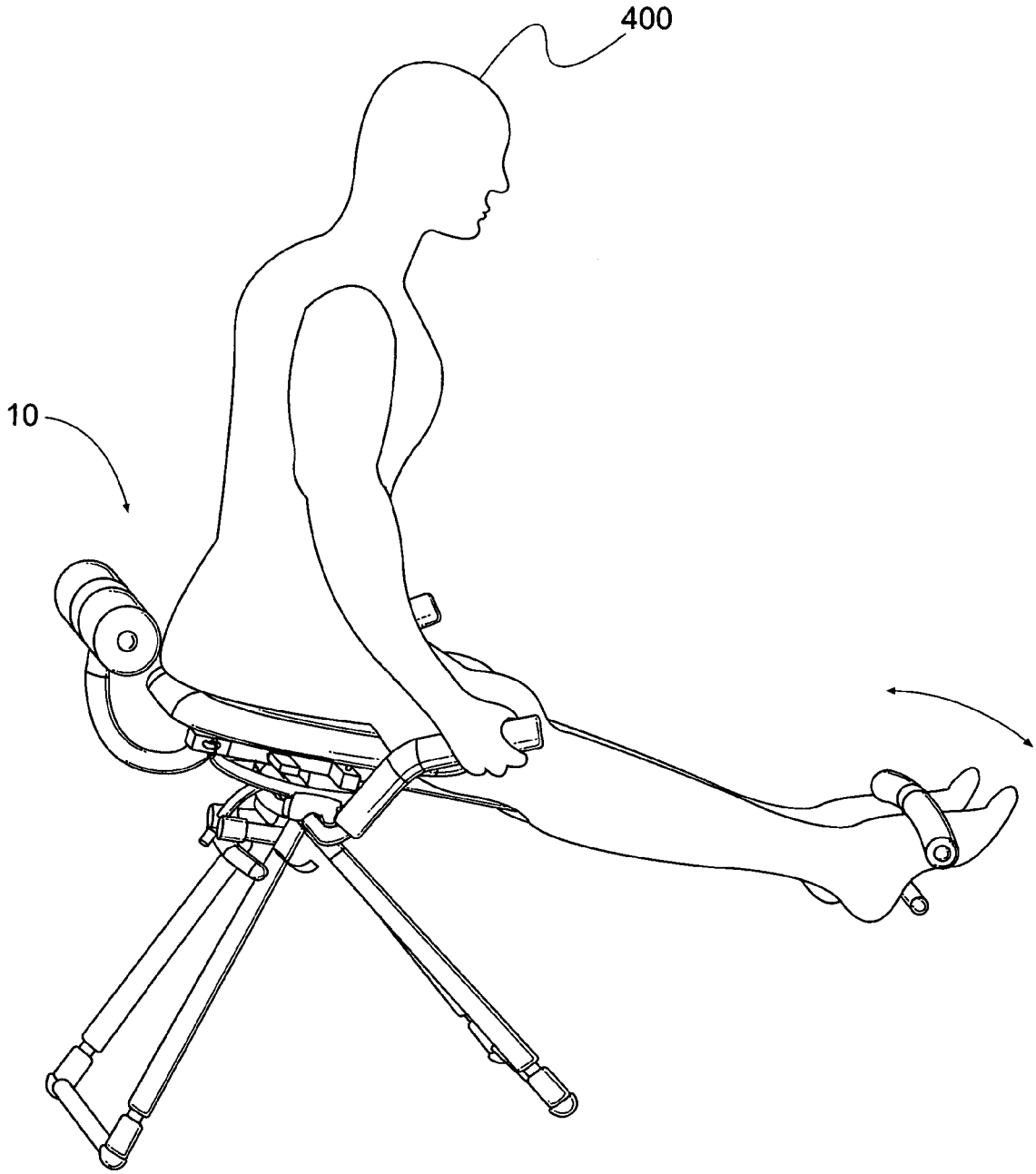
FIG. 4 is another perspective view of the user positioned on the exercise machine of FIGS. 1 and 2, wherein the user is alternately swinging his or her legs from one side, then to the other, in unison.

A seat 260 is attached to an underlying main member of the swing structure 100 for supporting the user. The seat 260 is during use of the exercise machine 10. The seat 260 is preferably generally planar, and is most preferably cushioned for the comfort of the user. Each of the pair of handle bars 252A and 252B are preferably positioned generally adjacent to opposite sides of the seat 260, to support a user during the use of the exercise machine 10 (as shown in FIGS. 3 and 4).

The swing structure 100 includes a pair of telescoping tubes 110: a first tube 112 and a second tube 114. The first tube 112 is coupled to the main member of the swing structure 100, and the second tube is extendably positioned within the first tube 112. As a result, the swing structure 100 is telescopically extendable.

The first tube 112 has a first set of holes along its length, and the second tube 144 positioned within the first tube 114 has a corresponding second set of holes along its length. A pin 116 is provided for inserting through lined-up members of the two sets of holes to temporarily fix an overall length of the swing structure 100. The two sets of holes and the pin 16 allow the overall length of the swing structure 100 to be adjusted by the user.

A gripping structure 120 is connected to an end of the second tube 114 of the swing structure 100 opposite the frame 102. The gripping structure 120 is provided for engaging the feet of a user of the exercise machine 10.

A back support assembly 300 is connected to an end of the swing structure 100 opposite the pair of telescoping tubes 110 and the gripping structure 120. The back support assembly 300 includes a back rest cushion 302 and a supporting arm 304 connected to the main member of the swing structure 100. The back support assembly 300 is provided to support the back of the user of the exercise machine 10.

Figure 2:
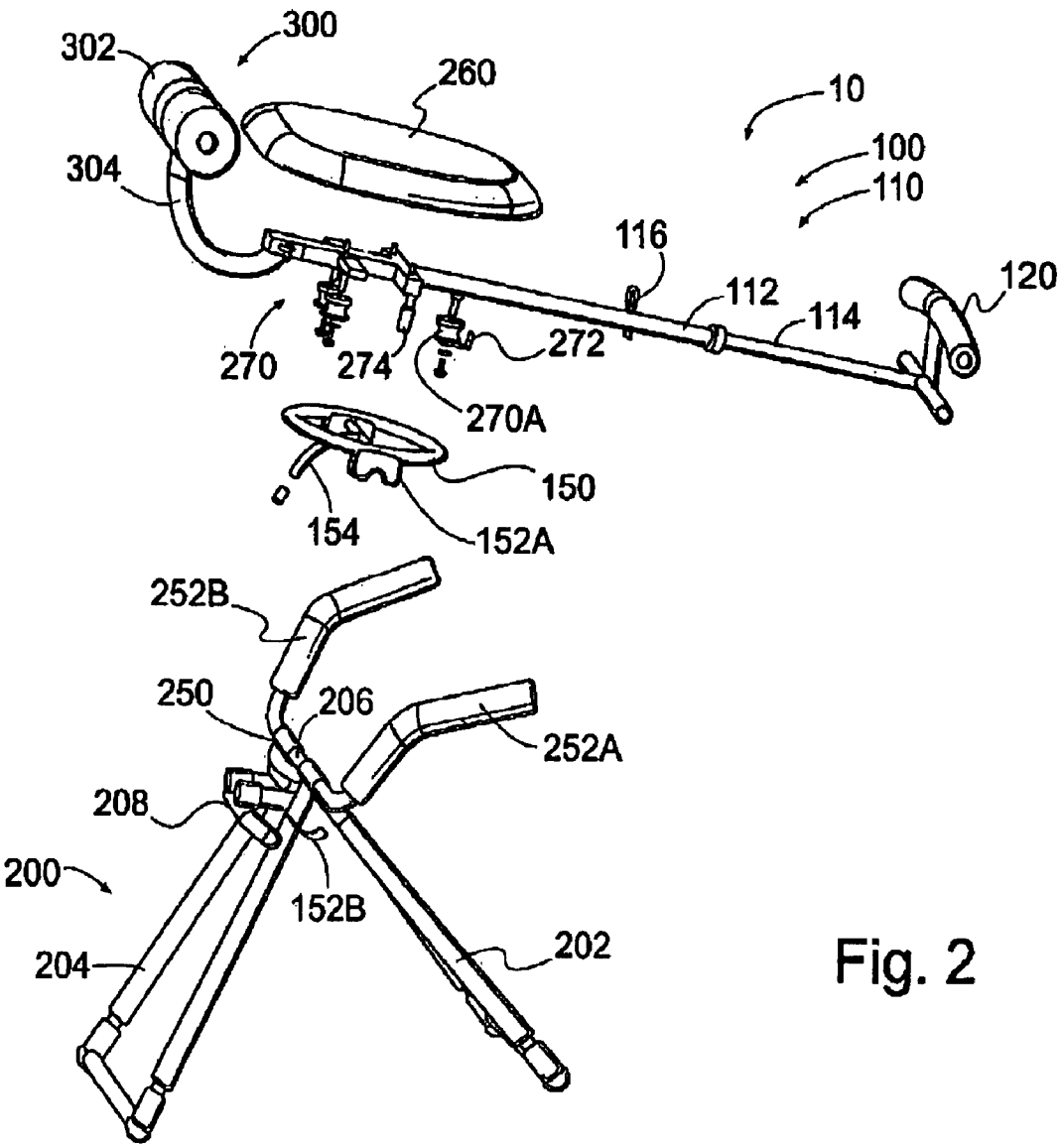
FIG. 2 is an exploded view of the exercise machine of FIG. 1.

FIG. 2 is an exploded view of the exercise machine 10 of FIG. 1. As shown in FIG. 2, the horizontal bar 250 is adjustably clamped to the top portion of the frame 200 via a clamp member 206. A right side of the ring 150 is pivotally connected to the horizontal bar 250 via a clamp member including a first portion 152A attached to the ring 150 and a second portion 152B located under the horizontal bar 250 in FIG. 2. The left side of the ring 150 is similarly connected to the horizontal bar 250 via another clamp member.

A limit bar 154 is attached to the ring 150. When the swing structure 100 is pivoted far enough that the limit bar 154 strikes a horizontal bar 208 attached to the back frame member 204, further travel of the swing structure 100 is prevented.

The main member of the swing structure 100 described above is labeled 120 in FIG. 2. As shown in FIG. 2, the main member 120 is rotatably connected to the top portion of the frame 200 at an underside surface. The seat 260 is attached to an upper surface of the main member 120. The first tube 112 of the pair of telescoping tubes 110 of the swing structure 100 is coupled an end of the main member 120, and the arm 304 of the back support assembly 300 is connected to an opposite end of the main member 120.

Three rollers 270 positioned between the main member 120 and the ring 150 are connected to an underside portion of the main member 120 and engage the ring 150 at three different points such that the main member 120 is rotatably connected to the ring 150 as described above. A retainer 272 ensures a corresponding one of the rollers 270 (labeled 270A in FIG. 2) continues to engage the ring 150, and a limit rod 274 limits the rotational travel of the swing structure 100 with respect to the frame 200.

It is noted that the exercise machine 10 of FIGS. 1 and 2 is relatively small and simple, and is light enough in weight to be highly portable.

FIG. 3 is a perspective view of the user, labeled 400 in FIG. 3, positioned on the exercise machine 10 of FIGS. 1 and 2. In FIG. 3 the user 400 is alternately raising and lowering his or her legs in unison. The resistance to this movement offered by the exercise machine 10 exercises the muscles of the abdomen and/or the lower back and the legs of the user 400. While raising and lowering the legs, the user 400 may grasp the handle bars 252A and 252B (see FIGS. 1 and 2) for increased stability as shown in FIG. 3. The back support assembly 300 (see FIGS. 1 and 2) provides increased safety.

FIG. 4 is another perspective view of the user 400 positioned on the exercise machine 10 of FIGS. 1 and 2. In FIG. 4 the user 400 is alternately swinging his or her legs from one side, then to the other, in unison. The resistance to this movement offered by the exercise machine 10 exercises the muscles of the abdomen and/or the lower back and the legs of the user 400. While swinging the legs from side to side, the user 400 may grasp the handle bars 252A and 252B (see FIGS. 1 and 2) for increased stability as shown in FIG. 4. Again, the back support assembly 300 (see FIGS. 1 and 2) provides increased safety.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An exercise machine, comprising:

a frame having a top portion with a horizontal bar attached at an apex of said frame;

a ring having a pair of clamp members comprising a top portion and a second portion, said first portion pivotally attached on a bottom surface of said ring and said second portion pivotally attached on a bottom surface of said horizontal bar, said first and second portions of said clamp members pivotally connecting said ring to said horizontal bar whereby said ring can pivot with respect to said frame;

a swing structure rotatably coupled to said ring, said swing structure including a main member extending outwardly to a griping structure, said main member further comprising a pair of telescoping tubes having a first end and a second end where said first end includes a plurality of rollers suspended from a bottom surface and contained within an inner diameter of said ring, and said second end includes said gripping structure whereby said rollers said rollers enable said swing structure to rotate with respect to said frame;

a seat attached to an upper surface of said swing structure; and a limit bar attached to said ring.

* * * * *